United States Patent [19]

Deutsch

[11] 4,178,825

[45] Dec. 18, 1979

[54] MUSICAL TONE SYNTHESIZER FOR GENERATING A MARIMBA EFFECT

[75] Inventor: Ralph Deutsch, Sherman Oaks, Calif.

[73] Assignee: Kawai Musical Instrument Mfg. Co. Ltd., Hamamatsu, Japan

[21] Appl. No.: 803,446

[22] Filed: Jun. 6, 1977

[51] Int. Cl.[2] ..... G10H 1/02

[52] U.S. Cl. ..... 84/1.24; 84/1.19; 84/DIG. 12

[58] Field of Search ..... 84/1.01, 1.19, 1.21, 84/1.24, 1.25, DIG. 12

[56] References Cited

U.S. PATENT DOCUMENTS

| | | | |
|---|---|---|---|
| 3,651,242 | 3/1972 | Evans | 84/1.19 |
| 3,809,788 | 5/1974 | Deutsch | 84/1.01 |
| 3,875,842 | 4/1975 | Kmetz | 84/1.01 |
| 3,992,971 | 11/1976 | Chibana | 84/1.19 |
| 4,048,480 | 9/1977 | Minot | 84/1.10 |

*Primary Examiner*—B. Dobeck
*Assistant Examiner*—Leonard W. Pojunas, Jr.
*Attorney, Agent, or Firm*—Christie, Parker & Hale

[57] ABSTRACT

A tone synthesizer generating a marimba effect in which two percussion notes are sounded alternately an ocatve interval apart, simultaneously with and in response to the playing of a sustained note by depressing a key. The marimba tones are synthesized by alternately, at controlled intervals, calculating master data lists of the amplitude values representative of points on the waveforms of the two marimba tones and converting the respective master lists to analog waveforms by feeding the data in series to a digital-to-analog converter. The master data list for each tone in calculated by multiplying a set of coefficients for each tone with a set of sinusoid values. The coefficients correspond in value to the relative amplitudes of the harmonics of the tone. By sounding one set of coefficients with the odd number harmonics all equal to zero, the two resulting tones sound an octave apart. By continuously scaling the harmonic values before multiplying with the sinusoid values of the waveform of the peak envelope, the two tones can be tailored to produce a percussive effect.

6 Claims, 2 Drawing Figures

MUSICAL TONE SYNTHESIZER FOR GENERATING A MARIMBA EFFECT

FIELD OF THE INVENTION

This invention relates to electronic musical instruments, and more particularly, is concerned with a tone synthesizer for producing a marimba effect.

BACKGROUND

A marimba effect is produced by alternately pounding two musical tones of different pitch in a percussive fashion. In an electronic organ or similar keyboard-operated instrument. An electronic organ or similar keyboard-operated instrument, the marimba effect is provided as an accompaniment or background to the music being played. Typically, when a note sounded by depressing a key on the keyboard, in addition to generating a conventional tone associated with that key, two percussive sounds at different frequencies are sounded alternately at a predetermined rate.

The present invention is directed to an electronic circuit for creating the marimba-type effect in a tone synthesizer of the type described in detail in co-pending application U.S. Ser. No. 603,776, filed Aug. 11, 1975, entitled "Polyphonic Tone Synthesizer" now issued as U.S. Pat. No. 4,085,644. The tone generator described in the above-identified application synthesizes a musical sound by computing a master data set, transferring the data set to a buffer memory from which the data is repetitively read out in real time at a rate determined by the pitch of the tone being generated, the data being applied to a digital to-analog converter, which transforms the buffer memory output data to an analog voltage waveform for driving an audio sound system. The master data set is created repetitively and independently of tone generation by computing a Fourier sine equation using stored sets of generalized Fourier coefficients and a table of sinusoid data.

The present invention is directed to improvements in a portion of the tone synthesizer described in the above-identified application to create a modified master data set to include information on the super imposed marimba effect.

SUMMARY OF THE INVENTION

In brief, the present invention involves a modification to the computational portion of a tone synthesizer of the type described in the above-identified application in which two additional harmonic coefficient memories are provided in addition to the memory storing the harmonic coefficients for the normal tone being generated. When a key is depressed, the master data list is repeatedly calculated using harmonic coefficients from a first and second one of the coefficient memories. After a predetermined period of time controlled by a Repeat clock, the master data list is calculated using harmonic coefficients from the outputs from the first and third harmonic coefficient memories. The coefficients from the second and third memories corresponding to tone components producing the marimba effect are applied to a scaler. The scale factor of the scaler changes as a function of time under the control of an ADSR generator to produce the percussive effect.

DESCRIPTION OF THE DRAWINGS

For a better understanding of the invention reference should be made to the accompanying drawings, wherein.

DETAILED DESCRIPTION

Figure 1:
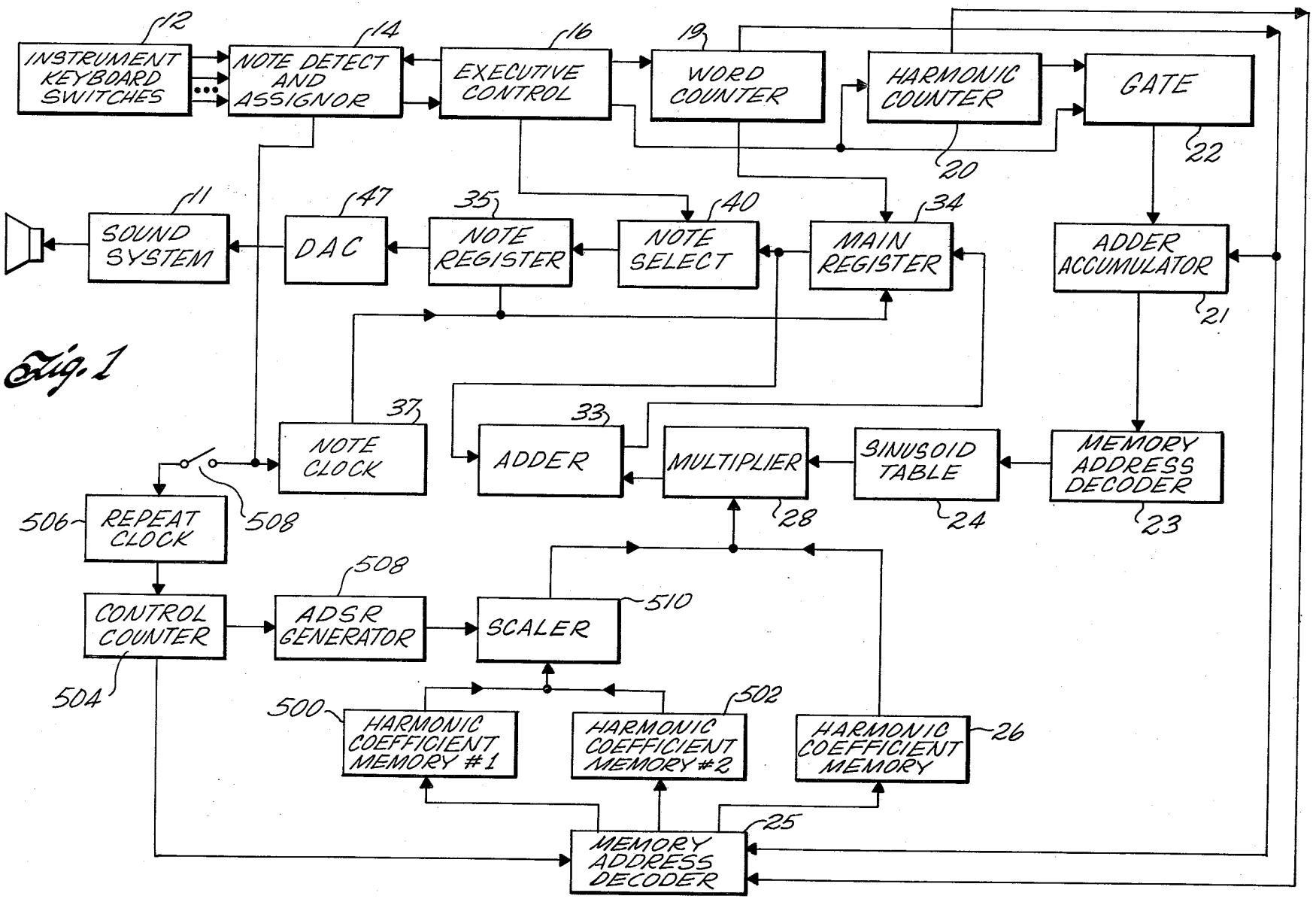
FIG. 1 is a block diagram of a tone synthesizer incorporating the features of the present invention.

The preferred embodiment of the present invention is implemented as a modification to the polyphonic tone synthesizer described in the above-identified copending application and the disclosure in the copending application is therefore incorporated herein by reference. In the drawings, all elements which are common to the disclosure in the above-identified application are identified by the same two-digit reference characters found in the prior patent application.

Referring in detail to FIG. 1, the tone synthesizer comprises a keyboard 12, the keyboard having a plurality of switches operated by the individual keys. When any key is depressed, a note detect and assignor circuit 14, described in detail in copending application Ser. No. 619,615 filed Oct. 6, 1975 now issued as U.S. Pat. No. 4,022,098, stores information during the time the associated switch is closed identifying the particular note and the octave of the note being played. An executive control circuit 16 receives a signal from the note detect and assignor circuit 14 indicating that a key is depressed. In response, the executive control 16 initiates a computation cycle in which a master data set is loaded in a main shift register 34. The manner in which the master data set is calculated is described in detail in application Ser. No. 603,776 filed Aug. 11, 1975.

After the master data set is loaded in the main register 34, the data set is transferred by a note select circuit 40, in response to the executive control 16, into a note shift register 35. The shift rate of the register 35 is controlled by a note clock 37, the clock frequency of a note clock 37 being set by the note and octave information derived from the note detect and assignor circuit 14. The note clock frequency is controlled so as to be proportional to the pitch of the note selected by the associated key on the instrument keyboard. Once the master data set is transferred from the main register 34 to the note shift register 35, the executive control 16 can initiate a new computation cycle to load the main register 34 with the same or a new master data set.

The master data set in the note register 35 is shifted to a digital-to-analog (DAC) converter 47 by the note clock 37, the converter generating an audio frequency output voltage having a fundamental frequency determined by the note clock 37. The amplitude of the audio output voltage changes in incremental steps proportional to the numbers successively shifted out of the note register 35. The analog voltage is applied to a sound system 11 for driving a loudspeaker which reproduces the synthesized tone.

As described in detail in the above-identified patent application Ser. No. 603,776, during the computation cycle the master data set is calculated from one or more sets of harmonic coefficients and from a set of sinusoid values stored in the sinusoid table 24. The calculation of the master date set is under the control of a word counter 19 and harmonic counter 20. After a computation cycle is initiated by a signal from the executive control 16, the word counter 19 is counted up in synchronism with the shifting of the main register 34. The word counter 19 has a modulo corresponding to the number of words stored in the main register 34 e.g., thirty-two. The word counter 19 addresses in sequence a set of sine values in the sinusoid table, the address of the set being different for each harmonic.

The harmonic coefficients in memory 26 are addressed in response to a harmonic counter 20 through a memory address decoder 25. Each coefficent from the memory 26 is applied as one input to the multiplier 28. The sinusoid values in the table 24 are addressed by an adder accumulator 21 through an address decoder 23. The contents of the harmonic counter are added to the accumulator with each count of the word counter 19.

The content of the harmonic counter 20 is gated to the adder accumulator through a gate 22 each time the harmonic counter 20 is advanced by the executive control 16. The adder accumulator 21 adds the number derived from the harmonic counter 20 to itself with each advance of the word counter 19. Thus as the harmonic counter corresponds to the first harmonic calculation, the output of the adder accumulator will advance from 1 to 32 so as to successively address the first 32 words in the sinusoid table 24. When the harmonic counter 20 advances to 2, corresponding to the second harmonic, the adder accumulator advances in increments of 2 from 2 through 64.

Thus, with each shift of the main register 34, a word correponding to the product of a harmonic coefficient from memory 26 and a sine value from the sinusoid table 24 is added to the existing word by adder 33 and stored in the same location as a new word in the main register 34. This calculation is repeated with each successive cycle of the word counter 19 until a product is developed between a harmonic coefficient with each of the sine values of a set of values in the table 24. During subsequent cycles of the word counter 19, the adder 33 adds the multiplication of each coefficient number in turn with the corresponding set of sine values in the table to the words already stored in the main register 34.

At the completion of the computation cycle, the master data set is transferred from the main register 34 to the note register 35 in synchronism with the note clock. The manner in which the two shift registers are synchronized during the transfer so as not to interrupt the flow of data to the digital- to-analog converter is described in detail in the above-identified application Ser. No. 603,776. Once the transfer is completed, the executive control 16 initiates a new computation cycle. The repetitive computation cycle allows the master data set to be modified as a function of time, permitting the envelope of the audio tone to be modulated in a manner hereinafter described in detail.

To implement the marimba effect in accordance with the present invention, two additional sets of harmonic coefficients are stored respectively in a harmonic coefficient memory #1 indicated at 500 and a harmonic coefficient memory #2 indicated at 502. Harmonic coefficient memory 26, harmonic coefficient memories 500 and 502 may be read-only memories which are addressed by the harmonic counter 20 and the memory address decoder 25. The three coefficient memories may be merely different addressable means of the same memory. The memory address decoder 25 includes a control flip-flop operated in response to the word counter 19 so as to alternately address the harmonic coefficient memory 26 and one or the other of the harmonic coefficient memories 500 and 502.

Whether the memory address decoder addresses harmonic coefficient memory #1 or harmonic coefficient memory #2 is determined by the output of a control counter 504 cycled in response to the output of a repeat clock 506. The repeat clock 506 fixes the rate at which the two octave apart notes forming the marimba sounds are alternately generated. The repeat clock 506 is connected to the note detect and assignor circuit 14 through a switch 508 which is closed when the marimba effect is turned on. Whenever a key is depressed on the instrument keyboard and is assigned to a tone generator by the note detect and assignor circuit 14, the repeat clock 506 is also turned on. When the key is released, the repeat clock is also turned off. After a predetermined number of clock pulses from the repeat clock 506, the control counter 504 causes the memory address decoder 25 to switch the output of the decoder 25 from one harmonic coefficient memory to the other. The switching is at the same time intervals at which the two marimba like tones are alternately sounded. Thus, a set of harmonic coefficients are applied sequentially one at a time from one or the other of the coefficient memories #1 and #2 to one input of the multiplier 28 and multiplied with the sine values from the sinusoid table 24 to be added to the words stored in the main register 34 in the same manner as described in detail in the above-identified co-pending application.

As described above, it will be appreciated that the fundamental frequency of the sound generated in response to the words stored in the main register 34 is fixed by the frequency of the note clock 37, which frequency is controlled in response to which key in the instrument keyboard 12 has been depressed. It is possible, however, to generate a second tone in response to the same key but sounding an octave higher. This is accomplished by setting all the odd harmonic coefficients to zero in harmonic coefficient memory #2 having the remaining even numbered harmonic coefficients equal in value to the first, second and third, etc. harmonic coefficient numbers in the other harmonic coefficient memory. Thus, to make the marimba tone sound an octave apart, the first, second, third, etc. harmonic coefficients in memory #1 are stored as the second, fourth, sixth etc. harmonic coefficients in memory #2, with all the intermediate odd harmonic coefficients set to 0 in memory #2. In this manner, two tones are alternately superimposed on the tone generated in response to the set of coefficients in the harmonic coefficient memory 26 to produce the marimba tones which alternate an octave apart. A superimposed sustained tone results from the coefficients in memory 26.

Figure 2:
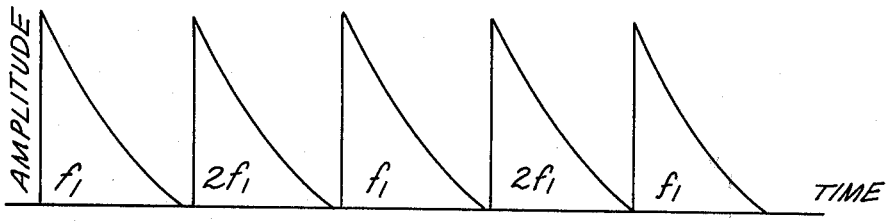
FIG. 2 is a graphical representation of a form of amplitude envelope characteristic of the marimba effect.

As also noted above, it is essential that the marimba tones have a percussive sound. This is accomplished by an ADSR generator 509, the output of which controls a scaler 510 for multiplying the harmonic coefficients read out of the harmonic coefficient memories #1 and #2 by a scale factor which changes exponentially with time. The desired waveform of the marimba tones is shown in FIG. 2. While the ADSR generator may take a variety of forms, such as the generator described in U.S. Pat. No. 3,610,805 or described in copending application Ser. No. 652,217 filed June 26, 1976 and entitled "ADSR Envelope Generator", a simpler and preferred method for controlling the scale factor for the marimba effect is shown in corresponding application Ser. No.

803,447; filed June 6, 1977, entitled "Amplitude Generator For An Electronic Organ".

What is claimed is:

1. In a keyboard operated digital tone generator in which a musical tone is produced by repeatedly calculating a master data set representing the relative amplitudes of a series of points on the waveform of the tone to be generated and converting the data set to an analog voltage input applied to a sound system, the data set being calculated when a key is depressed by multiplying in multiplier means a set of stored harmonic coefficients one coefficient at a time with a stored table of sinusoid values and summing the product values from one coefficient value with the product values from each of the other coefficient values to provide said data set, apparatus for producing a marimba effect comprising: means storing first and second sets of harmonic coefficients, means including a clock source for reading out coefficient values from the first set of harmonic coefficients in sequence during one clock interval of the clock source and coefficient values from the second set of harmonic coefficients in sequence, the sets being read out alternately during successive time intervals of the clock source, variable scaler means, means changing the scale factor of the variable scaler means in the same predetermined manner during each of said successive time intervals of the clock source, the harmonic coefficient values read out of said storing means being applied to said scaler means, the output of the scaler means being coupled to said multiplier means for calculating a master data set which changes in time with changes in the scale factor of the scaler means and with alternate reading out of the two sets of coefficient values, the coefficients in said second set having the odd numbered coefficients equal to zero.

2. Apparatus of claim 1 wherein: the means alternately reading out the two sets of coefficients includes means responsive to the operation of a key for initiating said alternating time intervals.

3. A tone generator comprising a keyboard, register means for storing a master data list defining the relative amplitude of points on the waveform of the tone to be generated, means responsive to the actuation of a key for repeatedly reading out the data list serially at a rate determined by the particular key, means converting the sequence of values of the master data list to an analog voltage, means converting the analog voltage to an audio tone, and means for recalculating the master data list and reloading the register means repeatedly while the key is depressed, the recalculating means including means storing a table of sinusoid values, means storing a plurality of sets of numerical coefficients, means multiplying each coefficient number from at least two of said sets successively with a series of values read out of said means storing a sinusoid table to generate a data set, adder-accumulator means receiving the output of the multiplying means for adding the successive data sets generated by each coefficient number for accumulating the master data list, means including a repeat clock started in synchronism with the actuation of a key for periodically substituting another of the numerical coefficient sets for one of said two sets to the multiplying means at time intervals which are very much longer than the master data list calculation time, whereby two different master data lists are calculated alternately during successive time intervals of the repeat clock.

4. The improvement of claim 3 further including scaler means coupling the numerical coefficients from said alternate sets of coefficient values read out of the storing means to the multiplying means, the scaler means multiplying the numerical coefficients by a predetermined scale factor.

5. The improvement of claim 4 wherein the scaler means includes means for changing the scale factor.

6. The improvement of claim 5 further including control means for changing the scale factor automatically as a predetermined function of time.

* * * * *